United States Patent [19]

Culpepper et al.

[11] 4,109,831

[45] Aug. 29, 1978

[54] PORTABLE SELF-CONTAINED LUBRICATING APPARATUS

[75] Inventors: William F. Culpepper; Charles G. Hinkle, both of Greer, S.C.

[73] Assignee: General Enterprises, Inc., Greer, S.C.

[21] Appl. No.: 783,328

[22] Filed: Mar. 31, 1977

[51] Int. Cl.[2] ..... B67D 5/52

[52] U.S. Cl. ..... 222/254; 222/263; 222/386.5

[58] Field of Search ..... 222/263, 254, 261, 256, 222/298, 386.5; 184/1, 5, 54, 105 R, 105 A

[56] References Cited

U.S. PATENT DOCUMENTS

| | | | |
|---|---|---|---|
| 1,221,288 | 4/1917 | Canaday | 222/263 X |
| 1,650,210 | 11/1927 | Hasty | 222/263 |
| 1,823,406 | 9/1931 | Peaden | 222/263 |
| 1,908,117 | 5/1933 | Clapp et al. | 222/254 |
| 2,242,288 | 5/1941 | Davis | 222/263 X |
| 2,718,343 | 9/1955 | Brown | 222/256 X |
| 2,735,589 | 2/1956 | Milster et al. | 222/386.5 |
| 2,879,785 | 3/1959 | Vesterdal et al. | 222/386.5 X |
| 3,248,020 | 4/1966 | Spalding | 222/263 X |

*Primary Examiner*—David H. Brown
*Attorney, Agent, or Firm*—Bailey, Dority & Flint

[57] ABSTRACT

A portable self-contained lubricating apparatus having a closed filling and dispensing system includes a wheeled frame member, a vertical lubricant container having an inlet and a bottom discharge outlet, and a flexible bladder carried within the container for pressurizing the lubricant with compressed air. A gear pump dispenses the lubricant from the container through a dispensing outlet at an elevated pressure. A rechargeable power source and a power drive is carried on the frame member for energizing and de-energizing the pump in response to respective low and high pressures at the dispensing outlet. A valve coupling member is connected to the container inlet having a pressure coupling for receiving a tubular connector to connect the container to a closed source of lubricant and a valve member for opening and closing a passageway between the inlet and pressure coupling providing a closed automatic filling system avoiding contact with outside contaminants and minimizing any exterior residue of lubricant.

14 Claims, 2 Drawing Figures

PORTABLE SELF-CONTAINED LUBRICATING APPARATUS

BACKGROUND OF THE INVENTION

Prior lubricating equipment has been developed for general use wherein a reservoir of lubricant is carried on a wheeled cart and is dispensed by a dispensing system having a pump and various pressure control valves such as shown in U.S. Pat. No. 2,141,022. This type of apparatus is filled through an open top and utilizes a follower plate for pressurizing the lubricant. While this type of portable equipment is suitable for general purposes, it is often not suitable for specialized uses requiring high maneuverability around closely spaced machinery and where cleanliness is required in manufacturing plants. While the lubricating apparatus of the present invention may be of general use as a lubricating apparatus, it has particular advantages for lubricating machinery in plants wherein the lubricating apparatus must be highly portable to maneuver in and around closely positioned machinery and must be completely self-contained to be transported large distances in the plant.

In many types of plants, a high degree of housekeeping and cleanliness is required, and the lubricating apparatus need be as clean as possible in its operation, particularly in avoiding any exterior residue of lubricant on the apparatus such as can occur during filling operations. For example, in lubricating textile and food preparation machinery, contact of the fabric or food with the lubricant must be prevented. It is also a common problem that the environment of many types of plants contains dust, trash or wood chips and the like which can contaminate the lubricant if allowed to contact it during filling operations. Once the contaminants are in the lubricant, fouling of the dispensing system and/or the fittings being lubricated can occur.

Safety in refilling operations has also been a problem with prior devices, especially with the type which employ a pressurized container with a pressure-cooker type lid and lock arrangement wherein the container interior space is pressurized directly with air. An unskilled worker unfamiliar with such apparatus can quite easily injure himself by unlocking the lid before relieving the pressure resulting in the lid flying off under pressure.

SUMMARY OF THE INVENTION

A portable self-contained lubricating apparatus is disclosed having a closed filling and dispensing system providing contamination-free lubrication comprising a wheeled frame member and a closed lubricant container carried on the frame member having a discharge outlet in a bottom portion thereof and a lubricant inlet in an upper portion thereof communicating with an interior space. A flexible bladder member is carried within the container for pressurizing the lubricant aiding flow through the container discharge outlet. A valve coupling assembly for connecting the inlet to a closed lubricant source via a tubular connector for filling the container with lubricant includes a pressure coupling for receiving a complimentary end portion of the tubular connector to provide a closed delivery line between the inlet and the source avoiding contact of the lubricant with outside contaminants. A valve member for selectively opening a passageway between the pressure coupling and the inlet permits delivery of the pressurized lubricant when opened and permits closing of the passageway following filling operations for disconnection of the tubular connector without leaving an exterior residue of lubricant. A dispensing system for dispensing lubricant from the container includes a pump having an inlet connected to the container outlet and a dispensing outlet for dispensing lubricant at an elevated pressure.

Accordingly, an important object of the present invention is to provide a portable self-contained lubricating apparatus which is compact and portable having a high degree of maneuverability in and around machinery.

Another important object of the present invention is to provide a portable self-contained lubricating apparatus which operates to dispense a lubricant at low pressures to reduce housekeeping problems while being sufficient to activate inert fittings.

Another important object of the present invention is to provide a portable lubricating apparatus having a rechargeable power source that is completely self-contained affording usage over a large distance range.

Yet another important object of the present invention is to provide a portable self-contained lubricating apparatus having a closed automatic refilling system which fills the lubricant container from a closed dispensing line with no contamination of the lubricant and cuts off automatically with no exterior residue of lubricant after disconnection resulting in a high degree of cleanliness.

Still another important object of the present invention is to provide a portable self-contained lubricating apparatus having a closed lubricant container and improved pressurization of the lubricant in the container resulting in total safety to the operator during filling operations.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
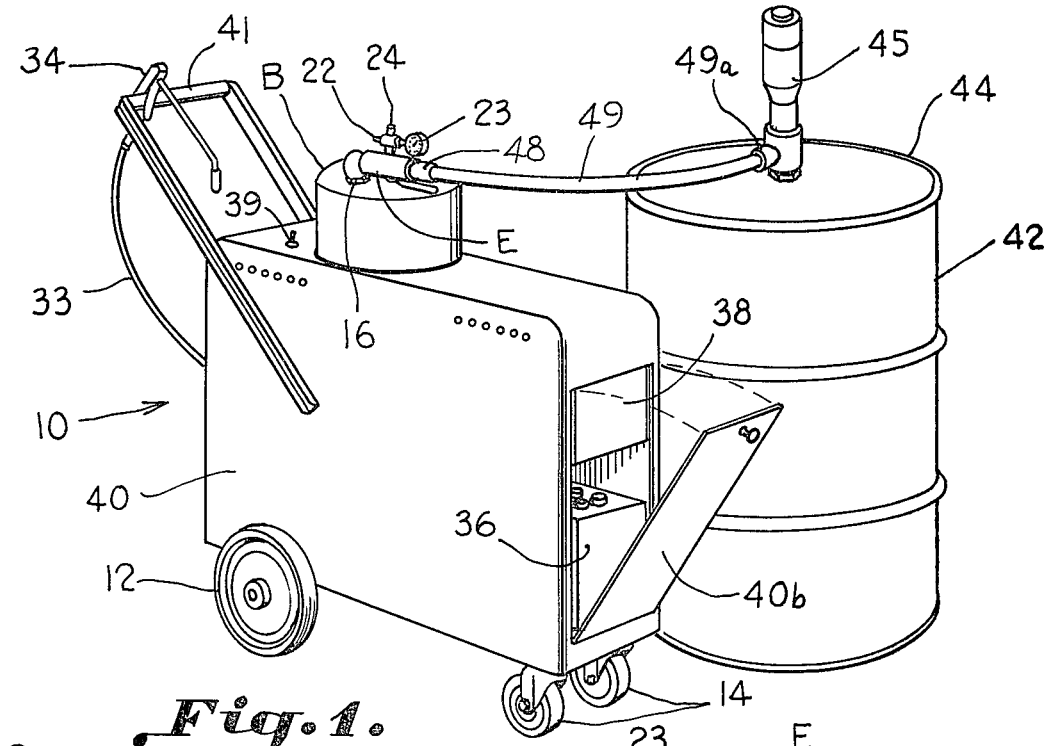
FIG. 1 is a perspective view illustrating the lubricating apparatus of the present invention having a closed filling and dispensing system.
Figure 2:
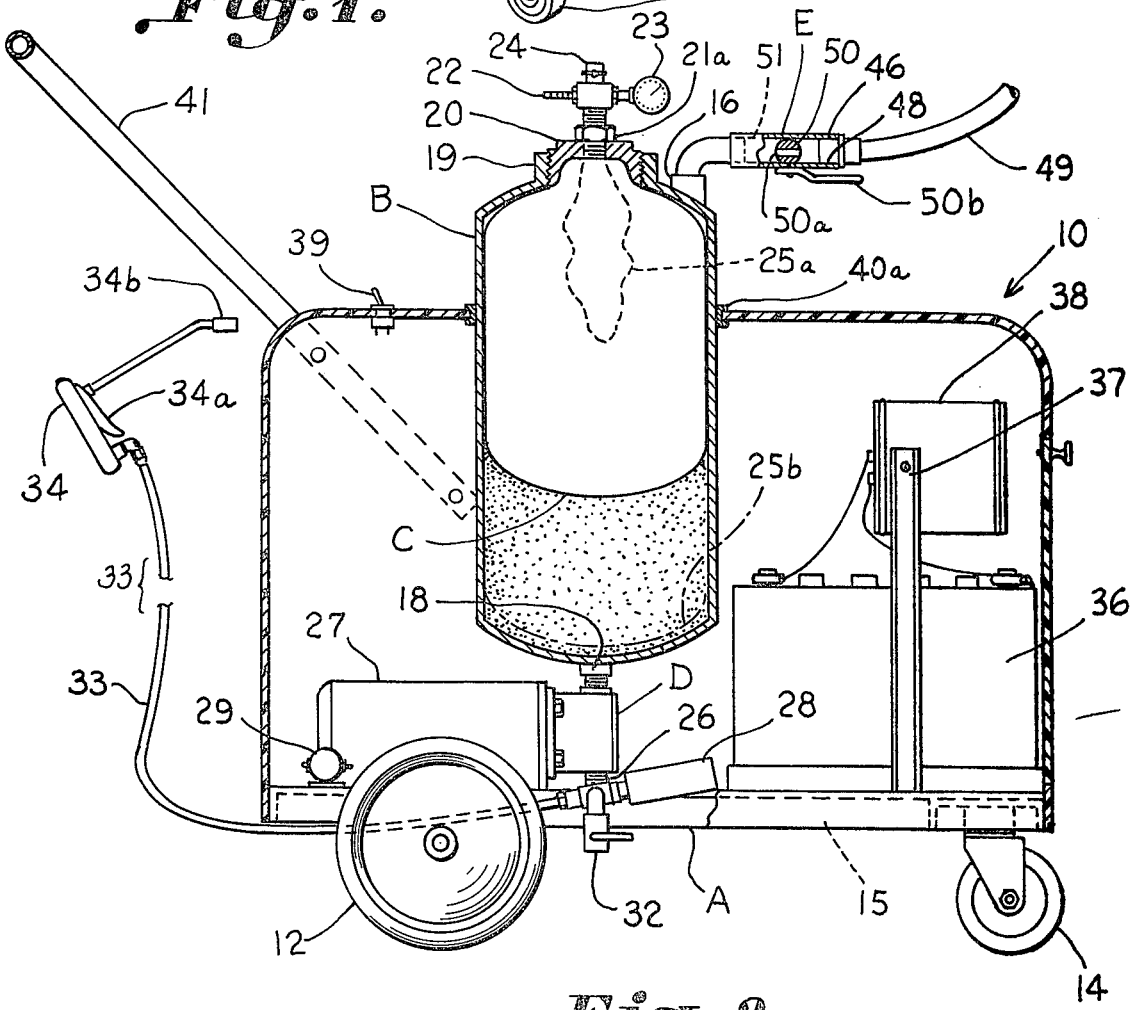
FIG. 2 is a cut-away side elevational view illustrating the various elements of a lubricating apparatus constructed in accordance with the present invention.

The invention is directed to a portable self-contained lubricating apparatus which is compact and highly maneuverable making it highly suitable for use in and around plants having large areas of closely positioned machinery. The apparatus has a closed filling and dispensing system avoiding contact with outside contaminants and avoiding redisual amounts of lubricant on the exterior of the apparatus making it highly advantageous for use in and around textile machinery and fabrics, food preparation machinery, and the like machinery where cleanliness and reduced housekeeping is desirable. The apparatus may be used with solid or fluid lubricants, but is particularly advantageous for use with solid lubricants which are more difficult to dispense and are messy to use especially in filling operations.

The drawing illustrates a portable self-contained lubricating apparatus designated generally as 10 including a wheeled frame member A and a vertical container B having an inlet for filling an interior space thereof with lubricant and a discharge outlet through which the lubricant is discharged under pressure. A flexible bladder member C is carried within the interior space of the container and has an inlet for receiving pressurized air or other suitable gas or fluid to cause the bladder to expand and pressurize the lubricant. A positive displacement pump D has an inlet suction side connected to the container discharge outlet and a pressure outlet for dispensing the lubricant at an elevated pressure. The dispensing outlet is adapted for connection to a lubricant delivery hose having a dispensing valve connected to a remote end for dispensing the lubricant. A power means for driving the pump D is provided and is controlled by a pressure sensitive switch which energizes and de-energizes the power means in response to predetermined low and high pressures, respectively. A valve coupling assembly E for connecting the container B to a closed source of lubricant via a tubular connector includes a pressure coupling for receiving the complimentary end of the tubular connector and a valve member for selectively opening and closing a passageway between the container inlet and the pressure coupling.

Referring now in more detail to the drawings, the wheeled frame member A includes a pair of rear wheels 12 and a pair of front swivel wheels 14 all of which are attached to and support the elongated rectangular frame 15. The lubricant container B is preferably a cylindrical container having a lubricant inlet 16 in an upper portion thereof and a discharge outlet 18 formed in a bottom portion thereof. Additional framework may be provided for supporting the container B on the frame A as is necessary. The container B includes a threaded neck flange 19 for threadably receiving a threaded plug member 20. The neck 19 and plug 20 are provided with pipe threads so as to allow a slight amount of air passage around the threads during filling and dispensing operations as will be more fully hereinafter explained.

The bladder C is preferably affixed to a metal sleeve 21 extended through an opening in plug 20 and secured thereto by a nut member 21*a*. An air inlet fitting 21 communicates with the interior of the bladder through the hollow sleeve 21 for filling the bladder with a compressed gas, such as air. A conventional pressure gauge 23 may be provided so as to indicate the inflated condition of bladder C. An air relief valve 24 is provided for relieving the pressure in the bladder C should an excess pressure be reached.

The bladder C is relieved of compressed air as shown in the dotted lines at 25*a* for purposes of filling the container with lubricant in the interior space thereof. Once the container is filled with lubricant, the bladder is then pressurized for maintaining a downward pressure on the lubricant to aid in discharging the lubricant through the bottom outlet 18. Since the container B remains closed during filling operations and the container interior is not directly pressurized as with prior devices, the injury resulting from unlocking a lid under pressure is eliminated.

When operating with a fluid lubricant, one which seeks its own level, the use of the bladder C is optional. However, the bladder C is necessary when operating with a solid lubricant in order to positively feed the pump D without cavitation. The bladder will expand to assume the shape of the interior of the container and scrape lubricant from the side of the container as it expands outward to the side walls and downwardly. As the lubricant is dispensed, it may be necessary that the operator return the lubricating apparatus to a source of compressed air for adding compressed air to the bladder C as the amount of lubricant is decreased in the container. At such time as the bladder expands to the position shown in the dash lines 25*b*, the portable lubricating apparatus is returned to a source of lubricant for refilling. The bladder C is preferably a neoprene bladder having a pressure capacity of 3000 psi.

The discharge outlet 18 of the container is connected to the suction side an inlet of positive displacement pump D which pumps the lubricant through a dispensing outlet 26 on the pressure side thereof. Preferably, the pump D is a conventional gear pump. A conventional DC motor 27 drives the input shaft of the gear pump in response to the dispensing pressure at the outlet 26. For this purpose, a pressure sensing switch 28 is connected to the dispensing outlet 26 for sensing the pressure thereat and for controlling a solenoid switch 29 which, in turn, controls the operation of motor 27. In a preferred embodiment, the pressure switch is of the differential pressure type and is set to operate in the range of 1200 to 1500 psi for a fluid lubricant and from 1800 to 2300 psi for a solid lubricant. Thus, when the lubricant pressure at 26 drops below the lower limits of the above ranges, the pressure switch 28 will close the contacts of solenoid 29 to energize the motor 27 and the pump D elevating the lubricant pressure at 26. If the lubricant pressure at 26 rises above the higher limits of the above ranges, the pressure switch 28 will open the contacts to the solenoid 29 and de-energize the motor 27 and pump D. In this manner, lubricant will be delivered at a controlled low pressure to prevent housekeeping problems which accompanies high pressure lubricating systems which operate in the range of 6000 to 8000 psi. The low pressure dispensing apparatus of the present invention will be sufficient to activate any frozen bearing fittings while avoiding the problem of exterior amounts of lubricant being blasted out of the bearing as is often the case in the high pressure system.

An air lock release valve 32 is connected to the dispensing outlet 26 of the pump D which may be utilized if an air lock develops in the gear pump. Opening of this valve would let the air out of the dispensing system and allow the gear pump to regain its prime. Valve 32 may be any conventional 2-way valve such as a ball-type valve.

A 6-foot lubricant delivery hose 33 is attached to the dispensing outlet 26 for dispensing the lubricant and includes a dispensing valve member 34 carried at the remote end thereof for controlling dispensing of lubricant. Depressing the trigger handle member 34*a* will open the valve and create a drop in pressure at the dispensing outlet 26 which will be sensed by the pressure sensitive switch 28 to close the contacts of solenoid 29 energizing the DC motor 27. A conventional lubricant coupling 34*b* is carried on the end of valve member 34 for coupling with the fitting to be lubricated to create a pressure coupling therebetween preventing any outward passage of lubricant.

The apparatus of the present invention is made completely self-contained by provision of a source of power 36 which is carried on the wheeled frame A and is preferably a 12 volt DC battery. A pair of upstanding legs 37 provide side brackets for mounting a battery charger 38 thereto directly above the battery 36. The battery charger 38 may be a conventional AC to DC battery charger connected across the battery 36 and adapted to be plugged into a conventional AC wall plug for recharging the DC battery 36.

It will be understood, of course, that a series electrical circuit with the solenoid switch 29, electric pump motor 27, the DC power source 36, and a conventional on-off toggle switch 39, may be used for the operation of the lubricant apparatus as described above. A fiberglass cover 40 is provided for covering the lubricating apparatus having a central aperture 40*a* through which the lubricant container B extends and a front door panel 40*c* for providing access to the battery 36 and charger 38 for charging operations. A handle member 41 is attached to the cover 40 as an expedient for maneuvering the portable lubricating device around close machinery and over large areas in textile plants in similar type industrial operations.

The valve coupling member E and operation thereof will now be described in more detail for filling the lubricant container C in an automatic and contamination-free manner. The valve coupling member E connects the container inlet 16 to a closed source of lubricant 42 which is illustrated as a 55 gallon drum of lubricant having a removable head 44 with an air operated transfer pump 45 fitted to a central portion thereof. As illustrated, the valve coupling member E includes a pressure coupling 46 for receiving a complimentary connecting end 48 of a tubular connector member 49 which is connected at a remote end thereof to the outlet of transfer pump 45 providing a closed delivery line between the closed source 42 and the lubricant container B.

The pressure coupling 46 may be provided by internal threads with the complementary end 48 being threaded and swivelably connected to tubular connector 49 or a quick-release type pressure coupling may be utilized. Generally, the coupling must be able to withstand a pressure of 30 to 60 psi without leakage.

The valve coupling E further includes a ball valve 50 having a passageway 50*a* and an exterior handle member 50*b*. It is to be understood, of course, that other suitable type valves may be provided. The rotation of the handle 50*b* aligns the valve passage 50*a* with a passageway 51 and opens the passageway between the pressure coupling 46 and inlet 16. Rotation of the handle 50*b* and the valve passage 50*a* out of alignment with the passageway 51 closes the valve and interrupts any lubricant delivery in the passageway.

During filling operations, the tubular connector 49 is connected to the valve coupling E and operation of the transfer pump 45 is switched on commencing the delivery of lubricant from the closed source 42 to the container B. The transfer pump 45 may be any suitable transfer pump such as a Model 226-226 Series A fast-flow pump manufactured by the Graco Corporation which is operated by an air motor. This pump delivers the lubricant at a pressure of approximately 30 psi into the interior space of container B. During filling operations the flexible bladder member C may be relieved of pressure so that the interior space of the container may be completely filled with lubricant under pressure.

Air is vented out of the container B during filling via the pipe threads of flange 19 and plug 20 which also permit air to enter the container during dispensing. When the container becomes filled with lubricant, a back pressure will be created in the delivery line 49 sufficient to cut off the transfer pump 45. The valve member 50 is then closed with the lubricant remaining in the container B at a pressure of approximately 30 psi. The tubular connector 49 may then be removed from the pressure coupling 46 without leaving any exterior residue of lubricant around the inlet which particularly reduces the problem of filling with a messy solid lubricant. The closed filling system also avoids any contact between the lubricant and any outside contaminant which may be in the environment in the plant. The lubricant remains contamination-free as it is dispensed from the closed lubricant delivery system through the valve dispensing member 34.

The container B acts as a closed vessel during the filling and dispensing operations in that plug 20 is not removed and the container is not opened to communication with the outside environment. Utilizing the flexible bladder C eliminates pressurization of the lubricant container, directly, and since it is not required that the container be opened for filling, no chance of an exploding lid is present affording total safety to the operator. Even an unskilled operator may fill the apparatus in total safety since the entire system is closed and automatic.

Thus, it can be seen that an advantageous construction can be had for a portable self-contained lubricating apparatus wherein a closed filling and dispensing system provides clean and contamination-free lubrication. The apparatus is highly portable having a high degree of maneuverability in and around closely spaced machinery and is self-contained so that it may be advantageously utilized in plants having a large area of machinery. A lubricant container is filled with lubricant from a closed system avoiding contamination from lint, wood particles, and other like contaminants, and the lubricant is kept pressurized for positive discharge from the lubricant container by means of a flexible bladder without exposure to the outside. The lubricating apparatus remains extremely clean during filling and dispensing so that it may be utilized in and around the weaving and knitting of materials where clean housekeeping is a necessity. The flexible bladder and closed filling system are highly expedient when operating with a solid lubricant.

While a preferred embodiment of the invention has been described using specific terms, such description is for illustrative purposes and it is to be understood that changes and variations may be made without departing from the spirit or scope of the following claims.

What is claimed is:

1. An improved portable lubricating apparatus of the type having a wheeled frame member, a lubricant container carried on said frame member for containing a lubricant, a pump means carried on said frame connected to said container for receiving said lubricant having a dispensing outlet for dispensing said lubricant at an elevated pressure, said dispensing outlet adapted for connection to a lubricant delivery hose having a dispensing valve connected to a remote end for controlling the dispensing valve connected to a remote end for controlling the dispensing of pressurized lubricant, and power means for driving said pump means the improvement comprising:

said container including a bottom portion having a discharge outlet connected to an inlet of said pump means, a coupling member carried by said container communicating with an interior space thereof adapted for connection to a closed lubricant source for filling said container with lubricant, a flexible bladder member carried within said container interior space having an inlet for receiving a pressurized gas to cause said bladder member to expand and pressurize said lubricant, and said coupling member and bladder member enabling said container to operate as a generally closed container during filling and dispensing operations under pressure affording total safety to the operator thereof.

2. The apparatus of claim 1 including an air lock relief valve located in communication with said dispensing outlet of said pump means for relieving air developed in said pump means allowing said pump means to regain its prime.

3. The apparatus of claim 1 wherein said coupling member includes a valve coupling assembly for connecting said container to a closed lubricant source via a tubular connector comprising:

a pressure coupling for receiving a complimentary end of said tubular connector; and a valve member for selectively opening and closing a passageway between an inlet of said container and said pressure coupling respectively during and following delivery of lubricant under pressure from said source so that filling of said container may be made avoiding contact of said lubricant with outside contaminants and minimizing any exterior residue of lubricant.

4. The apparatus of claim 3 including vent means carried by said container for venting air during said filling operations while allowing air to enter said container during dispensing operations.

5. The apparatus of claim 1 wherein said power means includes a D-C motor for driving said pump means and a D-C battery power source connected to said motor carried on said wheeled frame member.

6. The apparatus of claim 5 including a charger device carried on said frame member for charging said D-C power source and adapted for connection to an A-C power source.

7. The apparatus of claim 5 including a switch means connected between said D-C power source and said motor responsive to the pressure at said pump dispensing outlet for energizing said pump in response to a predetermined low pressure and de-energizing said pump in response to a predetermined high pressure.

8. A portable self-contained lubricating apparatus having a closed filling and dispensing system providing contamination-free lubrication comprising:

(a) a wheeled frame member;

(b) a vertical lubricant container carried on said frame member having a discharge outlet in a bottom portion thereof and a lubricant inlet in an upper portion thereof communicating with an interior space;

(c) a valve coupling assembly for connecting said inlet to a closed lubricant source via a tubular connector for filling said container with lubricant including:

(i) a pressure coupling for receiving a complimentary end portion of said tubular connector to provide a closed delivery line between said inlet and said source for delivery of lubricant under pressure, avoiding contact with outside contaminants, and (ii) a valve member for selectively opening a passageway between said pressure coupling and said inlet permitting delivery of said pressurized lubricant therethrough when opened and for closing said passageway following filling operations to allow for disconnection of said tubular connector without leaving an exterior residue of lubricant; and (d) dispensing means for dispensing lubricant from said container including pump means having an inlet connected to said container outlet and a dispensing outlet for dispensing lubricant at an elevated pressure.

9. The apparatus of claim 8 including a flexible bladder member carried within said container having an inlet for receiving a pressurized gas to cause said bladder to expand and pressurize said lubricant aiding flow through said container outlet.

10. The apparatus of claim 8 including vent means carried by said container for venting air from said container interior space as said container is filled with lubricant.

11. The apparatus of claim 8 wherein said pump means includes a gear pump and including power means for driving said gear pump and switch means responsive to the pressure at said dispensing outlet for energizing and de-energizing said power means in response to predetermined low and high pressures, respectively.

12. A portable self-contained lubricating apparatus comprising:

a vertical container carried on said frame member having an interior space for containing a lubricant;

said container having an inlet for being filled with lubricant and an outlet for discharging said lubricant;

a positive displacement pump carried on said frame having an inlet connected to said container discharge outlet for receiving lubricant from said container and a dispensing outlet for dispensing said lubricant at an elevated pressure;

said dispensing outlet adapted for connection to a lubricant delivery hose having a dispensing valve connected to a remote end for controlling the dispensing of pressurized lubricant;

a pump motor for driving said pump carried on said frame;

power source means for energizing said pump motor to drive said pump;

switch means connected between said power source means and said pump motor responsive to the pressure at said dispensing outlet of said pump for energizing said pump in response to a predetermined low pressure and de-energizing said pump in reponse to a predetermined high pressure; and a valve coupling assembly for connecting said container to a closed lubricant source via a tubular connector including a pressure coupling for receiving a complimentary end of said tubular connector; and valve means for selectively opening and closing a passageway between said container inlet and said pressure coupling.

13. The apparatus of claim 12 wherein said power source means includes a D-C battery carried by said frame.

14. The apparatus of claim 13 including a charger device carried on said frame member connected to said D-C battery power source for charging said D-C power source and adapted for connection to an A-C power source whereby said apparatus may be transported and utilized over large areas in a completely self-contained mode.

* * * * *